US006255783B1

(12) United States Patent
Parker

(10) Patent No.: US 6,255,783 B1
(45) Date of Patent: Jul. 3, 2001

(54) GAS DISCHARGE LAMP POWER SUPPLY WITH FEED FORWARD COMPENSATION FOR INPUT VOLTAGE VARIATIONS

(75) Inventor: Francis J. Parker, Cooper City, FL (US)

(73) Assignee: Ventex Group LLC, Riviera Beach, FL (US)

( * ) Notice: Subject to any disclaimer, the term of this patent is extended or adjusted under 35 U.S.C. 154(b) by 0 days.

(21) Appl. No.: 09/042,940

(22) Filed: Mar. 17, 1998

(51) Int. Cl.[7] ..... H05B 37/02

(52) U.S. Cl. ..... 315/219; 315/224; 315/291; 315/307

(58) Field of Search ..... 315/307, 224, 315/219, 209 R, 283, 220, 291, DIG. 7

(56) References Cited

U.S. PATENT DOCUMENTS

| | | | | |
|---|---|---|---|---|
| 3,781,638 | * | 12/1973 | Anderson et al. | 321/14 |
| 4,071,812 | * | 1/1978 | Walker | 363/80 |
| 4,240,009 | * | 12/1980 | Paul | 315/224 |
| 4,277,726 | * | 7/1981 | Burke | 315/98 |
| 4,628,284 | * | 12/1986 | Bruning et al. | 331/86 |
| 5,081,399 | | 1/1992 | Jy | 315/121 |
| 5,087,860 | | 2/1992 | Doss | 315/224 |
| 5,130,611 | | 7/1992 | Johns | 315/224 |
| 5,298,836 | | 3/1994 | Backmund et al. | 315/219 |
| 5,352,956 | | 10/1994 | Doss | 315/224 |
| 5,399,943 | | 3/1995 | Chandrasekaran | 315/219 |
| 5,410,466 | | 4/1995 | Maehara | 363/98 |
| 5,446,346 | | 8/1995 | Nilssen | 315/209 |
| 5,448,139 | | 9/1995 | Luursema et al. | 315/308 |
| 5,449,979 | | 9/1995 | Ueoka et al. | 315/225 |
| 5,466,992 | * | 11/1995 | Nemirow et al. | 315/276 |
| 5,502,635 | | 3/1996 | Bobel | 363/132 |
| 5,530,321 | | 6/1996 | Sears | 315/283 |
| 5,534,755 | | 7/1996 | Deavenport et al. | 315/307 |
| 5,677,602 | * | 10/1997 | Paul et al. | 315/224 |

* cited by examiner

*Primary Examiner*—Don Wong
*Assistant Examiner*—Thuy Vinh Tran
(74) *Attorney, Agent, or Firm*—Jay H. Maioli

(57) ABSTRACT

A power supply for a gas discharge lamp that provides a constant current to the lamp even when there are variations in a DC input voltage includes an inverter having a drive transformer that is controlled without negative feedback to operate close to its resonance condition, which permits a substantially constant load current even for large variations of the DC input voltage to the power supply.

15 Claims, 3 Drawing Sheets

GAS DISCHARGE LAMP POWER SUPPLY WITH FEED FORWARD COMPENSATION FOR INPUT VOLTAGE VARIATIONS

BACKGROUND

The present invention relates to power supplies for use with gas discharge lamps. More particularly, the present invention relates to a power supply for maintaining a constant brightness in a gas discharge lamp even in the presence of variations in input voltage to the power supply.

In general, conventional power supplies for a gas discharge lamp or tube limit the current provided to the lamp because the load corresponding to the lamp has a very low-slope impedance, which may be negative for certain values of input current, and which may lead to an unstable operating point for the tube.

Conventional power supplies for gas discharge lamps often do not compensate for variations in input voltage to the power supplies. Such variations in input voltage cause variations in the output current to the lamps, which result in variations in the brightness in the lamps as a function of the input voltage variations.

In many applications in which gas discharge lamps are used, it is desirable to have a reasonably constant brightness in the lamps even when fluctuations in input voltage occur. For example, in an application in which several power supplies are used together to power a lighting display formed of several lamps, with each power supply driving a separate lamp of the lighting display, the aesthetic value of the lighting display increases if the brightness or light intensity in each of the lamps is close in value. The lamps are usually connected by a parallel bus in a so-called "daisy chain" manner, such that the input voltage to a particular tube of the lighting display depends on the lamp's position on the bus. If the output current from each of the power supplies is not maintained at a reasonably constant value due to variations in the input voltage, then the brightness in each of the lamps in the lighting display will vary depending on its position on the bus.

OBJECTS AND SUMMARY OF THE INVENTION

In view of the above-mentioned considerations, it is an object of the present invention to provide a power supply for a gas discharge lamp that avoids the above-mentioned deficiencies.

It is another object of the present invention to provide a gas discharge lamp power supply that supplies a constant current to the lamp even when there are variations in the input voltage to the power supply.

It is also an object of the present invention to provide a gas discharge lamp power supply that operates at or close to the resonance point of the power supply.

According to an aspect of the present invention, a gas discharge lamp power supply includes an inverter for converting a DC input voltage to an AC input voltage, an inductor for limiting the current to the lamp, and a step-up transformer for providing a desired operating voltage to the lamp. The inverter includes a drive transformer which determines the operating frequency of the power supply. The power supply operates at or close to its resonance condition, and the current supplied to the lamp is within about 3% of the resonance current even for variations of about 20% in the DC input voltage to the power supply.

DETAILED DESCRIPTION OF PREFERRED EMBODIMENTS

Figure 1:
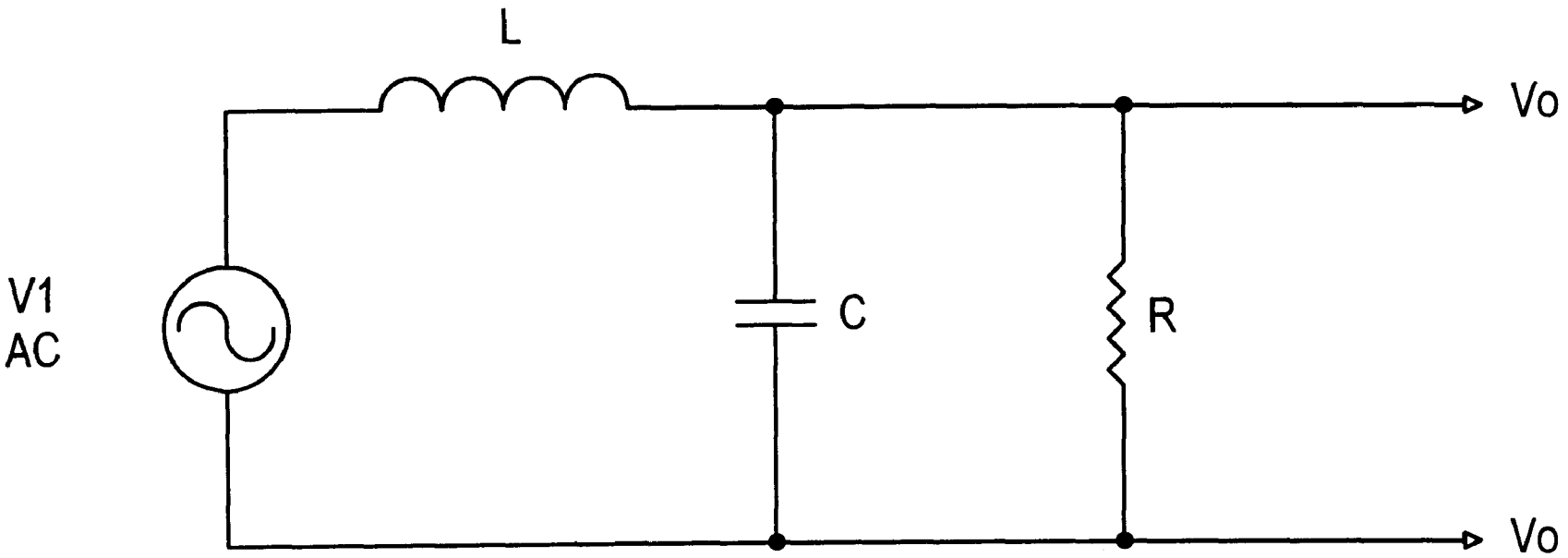
FIG. 1 is a diagram of an equivalent circuit of a power supply for a gas discharge lamp.

Preferred embodiments of a gas discharge lamp power supply which compensates for input voltage variations according to the present invention are described below with reference to the accompanying drawings, in which like reference numerals represent the same or similar elements.

As mentioned above, once a gas discharge is ignited in a gas discharge lamp or tube, the load corresponding to the tube has a very low-slope impedance, which may be negative depending on the value of the input current. Therefore, it is necessary to limit the current provided to the tube using an external impedance to prevent the tube from unstable operation.

FIG. 1 is a diagram of an equivalent circuit of a tube powered by a power supply. The tube is represented as a load R and the power supply is represented as a source of variable AC input voltage $V_i$. An inductor L provides current to the load R. The equivalent circuit of FIG. 1 has a capacitance that is provided either by a capacitor C by stray or distributed capacitance associated with the circuit itself, or by both.

For the equivalent circuit of FIG. 1, the ratio of the output voltage $V_o$ to the input voltage $V_i$ may be represented as:

$$\frac{V_o}{V_i} = \frac{R}{R + j\omega L - \omega^2 LCR}, \tag{1}$$

where ω corresponds to the frequency, in radians/second, of the AC voltage. The corresponding load current $I_R$ supplied to the load R may be represented as:

$$I_R = \frac{V_i}{R(1 - \omega^2 LC) + j\omega L}. \tag{2}$$

From equation (2) a resonance condition for the equivalent circuit of FIG. 1 may be found. That is, at resonance, where $\omega^2 LC=1$, the load current is:

$$I_R = \frac{V_i}{j\omega L}. \tag{3}$$

Therefore, at resonance the load current $I_R$ is independent of the actual value of the load R and is dependent only on the variable input voltage $V_i$ the frequency of the AC voltage ω and the inductance value of the inductor L.

Equation 2 may be rewritten in a simplified form:

$$I_R = \frac{V_i}{X + jY}, \tag{4}$$

with the magnitude of the load current $I_R$ represented as:

$$I_R = \frac{V_i}{(X^2 + Y^2)^{1/2}}. \tag{5}$$

In equation (4), even if the real portion X of the denominator has a value as high as about 33% of the imaginary portion jY, equation (5) shows that the magnitude of the load current $I_R$ will differ by only about 5% from its magnitude at resonance. Therefore, to a first approximation, equation (3) may be assumed to be valid over a modest range of frequencies above and below resonance.

Figure 2:
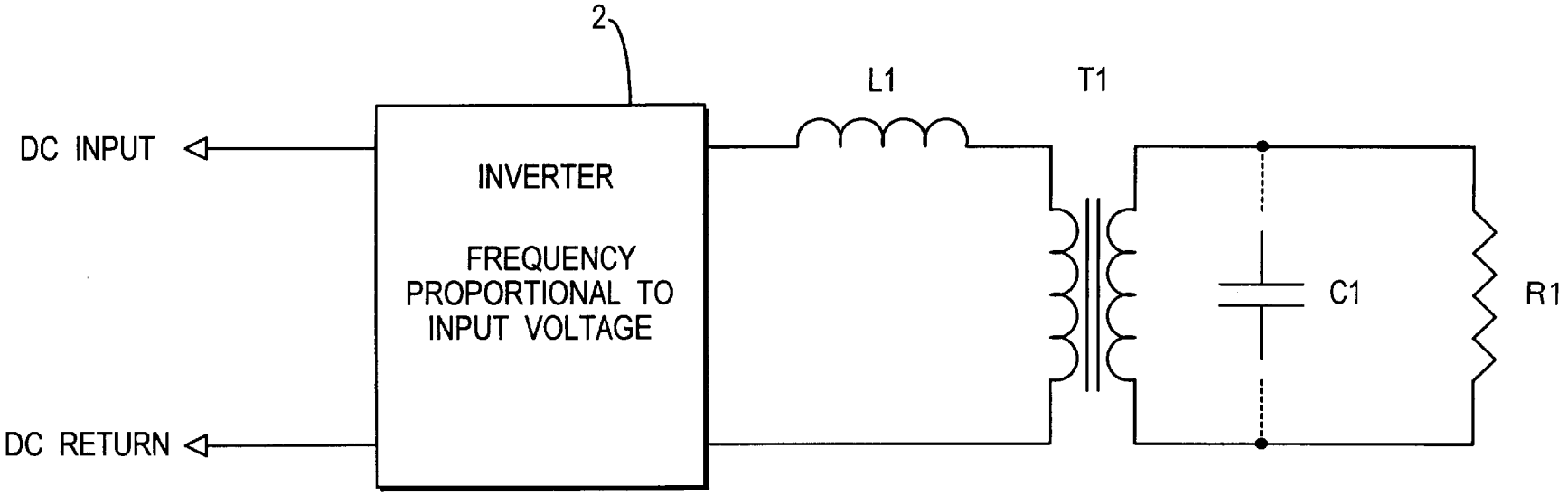
FIG. 2 is a diagram of an equivalent circuit of a another power supply for a gas discharge lamp.

FIG. 2 is a variation of the equivalent circuit of FIG. 1 and shows an inverter 2 for converting a DC input voltage to an AC input voltage having a frequency that is proportional to the DC input voltage. Instead of providing current directly to the load R1, the current from the inductor L1 drives a step-up transformer T1 that provides the desired operating voltage to the load R1. The capacitance in the circuit of FIG. 2 is provided by the stray capacitance C1 associated with the load R1 and the secondary windings of the step-up transformer T1, and additional capacitance may be provided by an actual capacitor (not shown) connected to the primary windings of the step-up transformer T1.

If the conditions of equation (3) are satisfied within reasonable variations, as discussed above, then a reasonably constant load current $I_R$ is supplied to the load R1, with the magnitude of the load current $I_R$ being set by the operating parameters of the circuit.

Figure 3:
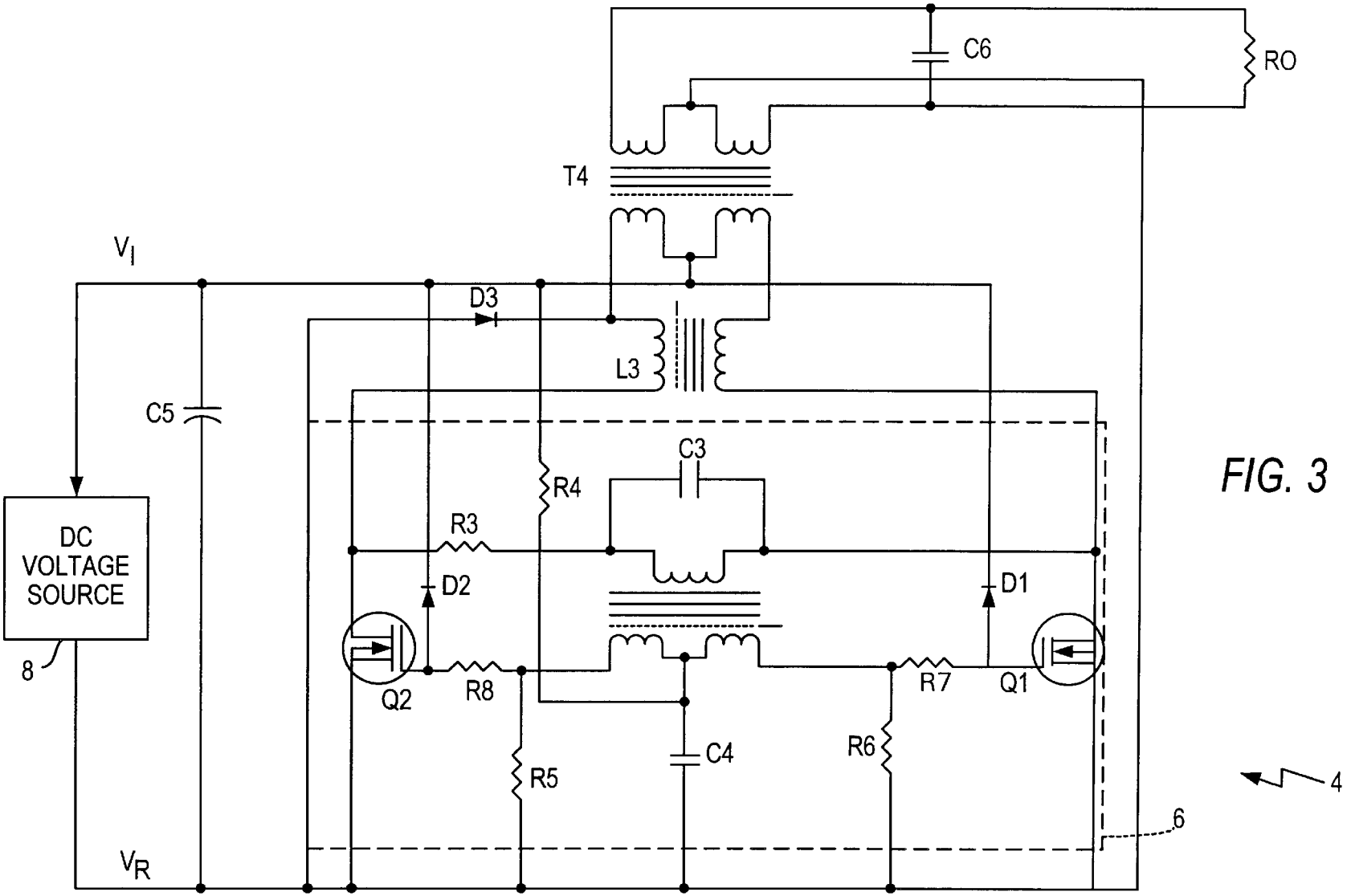
FIG. 3 is a diagram of a power supply for a gas discharge lamp according to an embodiment of the present invention.

FIG. 3 shows a power supply 4 for powering a gas discharge lamp or tube (not shown) represented by a load R0, according to an embodiment of the present invention.

A DC voltage source 8 produces a DC input voltage $V_I$ that is supplied to an inverter circuit 6 for converting the DC input voltage $V_I$ to an AC input voltage. The inverter circuit 6 includes switches Q1 and Q2 and a drive transformer T3 that drives the gates of the switches Q1 and Q2. The operating frequency of the power supply 4 is determined by core saturation of the drive transformer T3 and is a function of the voltage across the primary windings of the drive transformer T3.

The DC input voltage $V_I$ is preferably a low voltage, such as 12 $V_{DC}$, but other DC voltages may also be used.

The switches Q1 and Q2 are preferably field effect transistor devices such as MOSFETs, for example.

The inverter 6 is connected to a double-wound inductor L3 that acts as a current limiter for limiting the current to the load R0, which represents the tube. The phasing of the inductor L3 is such that it behaves essentially as an AC inductor. The inductor L3 has two windings each connected in series with the center-tapped primary windings of a step-up transformer T4. The step-up transformer T4 provides the desired operating voltage to the load R0.

A resistor R3 connected in series with the primary windings of the drive transformer T3 serves to prevent current surges from occurring once the drive transformer T3 reaches core saturation. The resistor R3 and a capacitor C3 connected in parallel with the secondary windings of the drive transformer T3 act in conjunction as a so-called snubber for limiting the amplitude of any spikes produced by the switches Q1 and Q2, such as at the drains of the switches Q1 and Q2, for example.

The capacitance in the circuit of FIG. 3 is provided by stray capacitance associated with the load R0 and the secondary windings of the step-up transformer T4, and additional capacitance may be provided by a capacitor C6 connected to the primary windings of the step-up transformer T4.

Starting resistors R4, R5, and R6 provide a DC bias at the gates of the switches Q1 and Q2 to ensure that the power supply 4 produces a discharge in the tube represented by the load R0. A capacitor C4 connected to the center-tapped windings of the drive transformer T3 is of low impedance and allows the drive transformer T3 to drive the gates of the switches Q1 and Q2 with a sufficiently high current to ensure a fast switching time. Diodes D1 and D2 prevent the gates of the switches Q1 and Q2 from acquiring an excessively positive voltage.

Because the power supply 4 is designed to operate near resonance, as discussed above, if the load R0 is removed a dangerously high output voltage would develop. The high output voltage would only be limited by saturation of the step-up transformer T4. Therefore, to prevent such a condition, a diode D3 is connected at the primary windings of the step-up transformer T4 to clamp the voltage in the primary windings and prevent the voltage from becoming more negative that the DC return voltage $V_R$.

In operation, the power supply 4 of FIG. 3 is able to provide a reasonably constant current to the load R0, with the current being maintained to within about ±3% of the resonance current for a variation of about 20% in the DC input voltage $V_I$. This is achieved because of the constant product (volts•seconds) of the saturated drive transformer T3, which produces an operating frequency that varies in proportion to variations in the DC input voltage. That is, the product of the AC input voltage and the time to saturation of the drive transformer T3 is constant.

The embodiments described above are illustrative examples of the present invention and it should not be construed that the present invention is limited to those particular embodiments. Various changes and modifications may be effected by one skilled in the art without departing from the spirit or scope of the invention as defined in the appended claims. For example, the power supply 4 may be modified to use bipolar transistor devices for the switches Q1 and Q2, instead of field effect transistor devices.

What is claimed is:

1. A power supply for a gas discharge lamp, the power supply comprising:

a circuit for providing a constant current to the gas discharge lamp by compensating for variations in a DC voltage input to the circuit and variations in a load provided by the gas discharge lamp, wherein the circuit for providing a constant current includes means for operating without closed loop feedback.

2. The power supply according to claim 1, further comprising means for operating the circuit for providing a constant current at or close to its resonance condition.

3. The power supply according to claim 1, wherein the circuit includes means for providing an AC operating frequency that varies in proportion to variations in the DC voltage input to the circuit.

4. A power supply for a gas discharge lamp, the power supply comprising:

an inductor for limiting current to the gas discharge lamp;

a step-up transformer connected in series with the inductor for providing an AC operating voltage to the gas discharge lamp; and means for varying a frequency of an AC input voltage to the step-up transformer to thereby regulate the current to the gas discharge lamp regardless of variations in a DC input voltage to the power supply and variations in a load provided by the gas discharge lamp.

5. The power supply according to claim 4, further comprising an inverter for converting a DC input voltage to the power supply to the AC input voltage to the step up transformer, wherein the means for varying varies the frequency of the AC input voltage such that the frequency of the AC input voltage varies in proportion to variations in the DC input voltage.

6. The power supply according to claim 5, further comprising capacitance means connected to the step-up transformer, wherein the power supply operates at or close to a resonance condition established by an inductance of the inductor, the frequency of the AC input voltage, a capacitance of the capacitance means, and an impedance of the gas discharge lamp.

7. The power supply according to claim 6, wherein the capacitance means comprises stray capacitance from the step-up transformer and the gas discharge lamp.

8. The power supply according to claim 6, wherein the capacitance means comprises a capacitor connected in series with the inductor.

9. A power supply for a gas discharge lamp, the power supply comprising:

an inverter for converting a DC input voltage to the power supply to an AC input voltage;

an inductor connected in series with the inverter for limiting current to the gas discharge lamp; and a step-up transformer connected in series with the inverter for providing an AC operating voltage to the gas discharge lamp, wherein the inverter controls a frequency of the AC input voltage to maintain the current to the gas discharge lamp at a constant value regardless of variations in the DC input voltage and variations in a load provided by the gas discharge lamp without using closed loop feedback.

10. The power supply according to claim 9, wherein the current to the gas discharge lamp is a resonance current corresponding to a resonance condition determined by a frequency of the AC input voltage, an inductance of the inductor, stray capacitance of the step-up transformer and the gas discharge lamp, and an impedance of the gas discharge lamp.

11. The power supply according to claim 9, further comprising a capacitor connected to the step-up transformer, wherein the current to the gas discharge lamp is a resonance current corresponding to a resonance condition determined by a frequency of the AC input voltage, an inductance of the inductor, a capacitance of the capacitor, and an impedance of the discharge lamp.

12. The power supply according to claim 9, wherein the inverter includes a drive transformer for controlling a frequency of the AC input voltage to vary in proportion to variations in the DC input voltage.

13. The power supply according to claim 12, further comprising a clamping resistor connected to the drive transformer for preventing current surges when the drive transformer is in a core saturation state.

14. The power supply according to claim 13, wherein the inverter further comprises:

a snubbing capacitor connected to the drive transformer; and a pair of transistor switches connected to be driven by the drive transformer, wherein the snubbing capacitor operates in conjunction with the clamping resistor to provide amplitude reduction of spikes produced when the pair of transistor switches switch states.

15. The power supply according to claim 9, wherein the inverter includes a saturating drive transformer for controlling variations in a frequency of the AC input voltage in proportion to variations in the DC input voltage, whereby a product of the AC input voltage and a saturation time constant of the saturation drive transformer is maintained constant.

* * * * *